US009080772B2

(12) United States Patent
Prociw et al.

(10) Patent No.: US 9,080,772 B2
(45) Date of Patent: Jul. 14, 2015

(54) CONTINUOUS IGNITION

(71) Applicant: Delavan Inc, West Des Moines, IA (US)

(72) Inventors: Lev Alexander Prociw, Johnston, IA (US); Jason Allen Ryon, Carlisle, IA (US); Steven Jay Myers, West Des Moines, IA (US); Nicole L. Nelson, Des Moines, IA (US); Roger A. Seei, Dallas Center, IA (US)

(73) Assignee: Delavan Inc, West Des Moines, IA (US)

( * ) Notice: Subject to any disclaimer, the term of this patent is extended or adjusted under 35 U.S.C. 154(b) by 56 days.

(21) Appl. No.: 13/917,053

(22) Filed: Jun. 13, 2013

(65) Prior Publication Data

US 2014/0366551 A1 Dec. 18, 2014

(51) Int. Cl.

| | |
|---|---|
| ***F23R 3/20*** | (2006.01) |
| ***F23R 3/28*** | (2006.01) |
| ***F23R 3/14*** | (2006.01) |

(52) U.S. Cl.

CPC ... *F23R 3/20* (2013.01); *F23R 3/14* (2013.01); *F23R 3/28* (2013.01); *F23C 2900/03005* (2013.01); *F23D 2207/00* (2013.01); *F23D 2900/11401* (2013.01); *F23N 2027/02* (2013.01)

(58) Field of Classification Search

CPC ..... F23R 3/14; F23R 3/20; F23R 3/28

USPC ..... 60/39.821, 39.826

See application file for complete search history.

(56) References Cited

U.S. PATENT DOCUMENTS

| | | | | | |
|---|---|---|---|---|---|
| 2,847,826 | A | * | 8/1958 | Howes | 60/39.826 |
| 2,864,234 | A | * | 12/1958 | Seglem et al. | 60/39.826 |
| 2,929,210 | A | * | 3/1960 | Howes | 60/39.826 |
| 2,967,224 | A | * | 1/1961 | Irwin | 361/266 |
| 3,009,321 | A | * | 11/1961 | Jones et al. | 60/39.821 |
| 3,954,389 | A | * | 5/1976 | Szetela | 431/353 |
| 4,073,134 | A | * | 2/1978 | Koch | 60/39.23 |
| 4,141,213 | A | * | 2/1979 | Ross | 60/39.821 |

(Continued)

FOREIGN PATENT DOCUMENTS

| | | | |
|---|---|---|---|
| DE | 102011018846 | A1 | 7/2012 |
| EP | 1508744 | A1 | 2/2005 |

(Continued)

OTHER PUBLICATIONS

Extended European Search Report and Opinion issued in corresponding European Application No. 14172360.1, dated Oct. 14, 2014, 6 pages.

(Continued)

*Primary Examiner* — Gerald L Sung
*Assistant Examiner* — Scott Walthour
(74) *Attorney, Agent, or Firm* — Locke Lord LLP; Scott D. Wofsy; Christopher J. Cillié

(57) ABSTRACT

An ignition system includes a housing defining an interior and an exhaust outlet. The housing is configured and adapted to be mounted to a combustor to issue flame from the exhaust outlet into the combustor for ignition and flame stabilization within the combustor. A fuel injector is mounted to the housing with an outlet of the fuel injector directed to issue a spray of fuel into the interior of the housing. An igniter is mounted to the housing with an ignition point of the igniter proximate the outlet of the fuel injector for ignition within the interior of the housing.

20 Claims, 4 Drawing Sheets

(56) References Cited

U.S. PATENT DOCUMENTS

| | | | | |
|---|---|---|---|---|
| 4,192,139 | A * | 3/1980 | Buchheim | 60/739 |
| 4,860,533 | A * | 8/1989 | Joshi | 60/776 |
| 5,154,049 | A * | 10/1992 | Ford et al. | 60/796 |
| 5,636,511 | A * | 6/1997 | Pfefferle et al. | 60/39.822 |
| 6,298,659 | B1 | 10/2001 | Knuth et al. | |
| 2009/0139241 | A1 * | 6/2009 | Hirata et al. | 60/746 |
| 2014/0080072 | A1 | 3/2014 | Smirnov et al. | |

FOREIGN PATENT DOCUMENTS

| | | | |
|---|---|---|---|
| GB | 717755 | A | 11/1954 |
| WO | 2007113186 | A1 | 10/2007 |

OTHER PUBLICATIONS

European Search Report and Opinion issued in European Application No. 14172327.0, dated Oct. 7, 2014, 6 pages.

* cited by examiner

Fig. 2
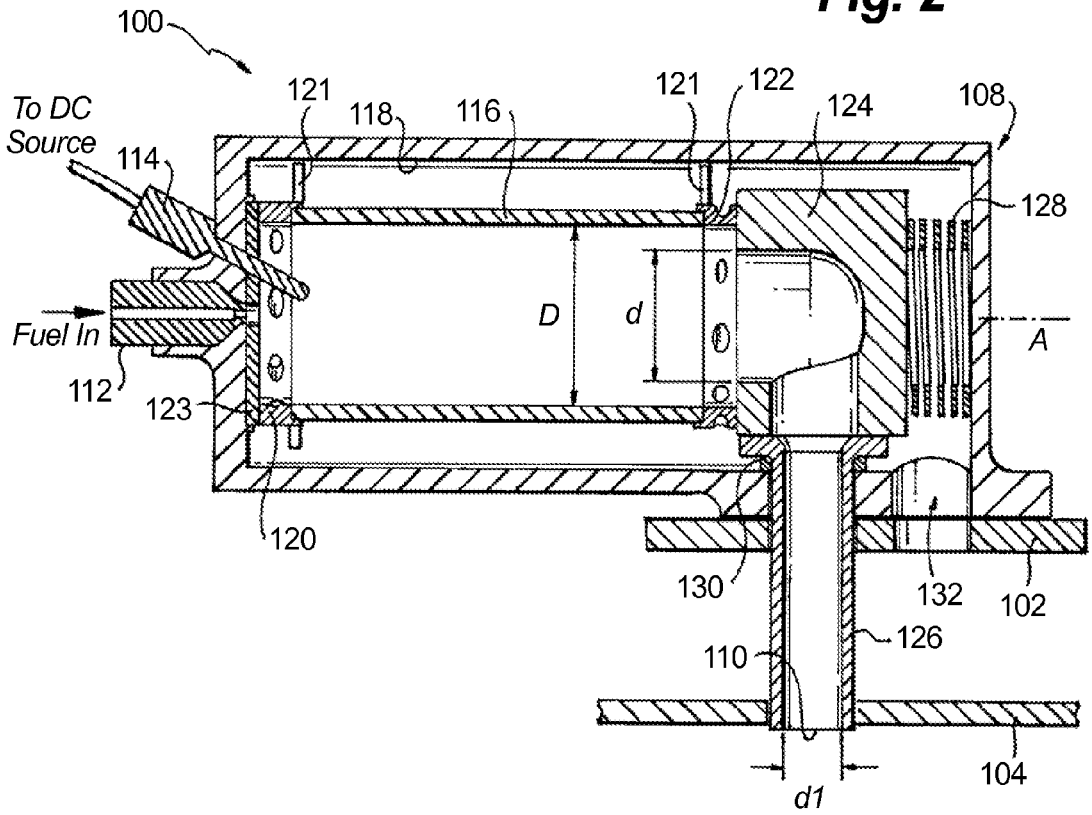
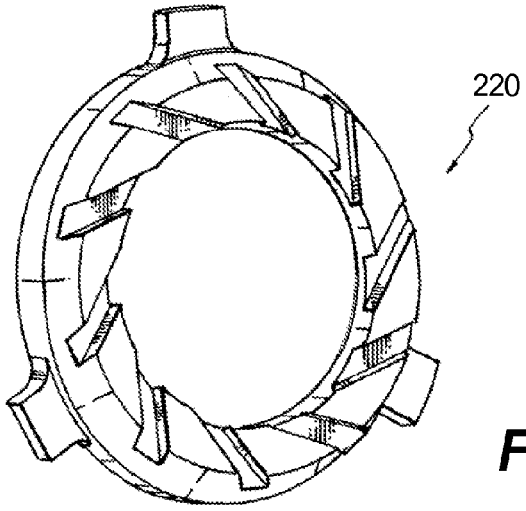
Fig. 3

Fig. 4
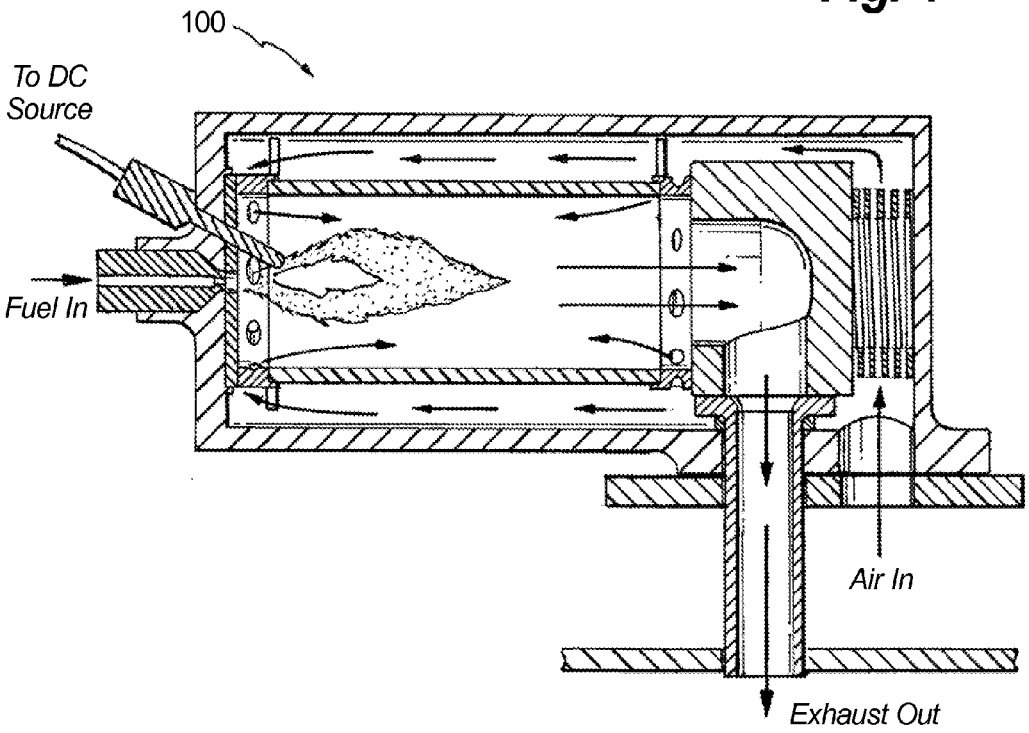
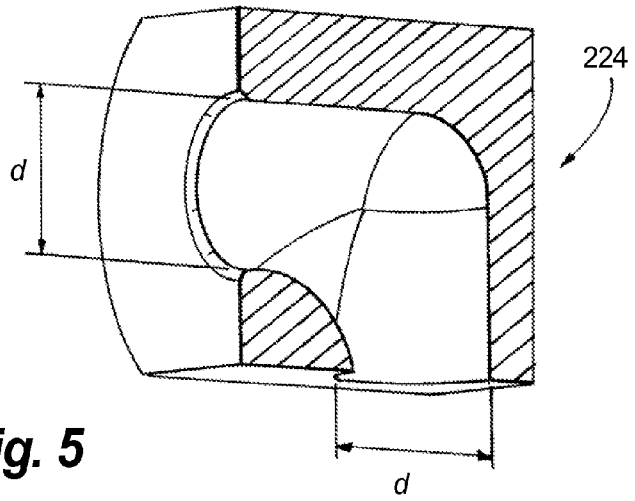
Fig. 5

CONTINUOUS IGNITION

BACKGROUND OF THE INVENTION

1. Field of the Invention

The present invention relates to combustion, and more particularly to ignition systems such as in gas turbine engines.

2. Description of Related Art

A variety of devices are known for initiating combustion, for example in a gas turbine engine. Many gas turbine engines use spark igniters for ignition. One or more spark igniters are positioned to ignite a fuel and air mixture to initiate the flame in the combustor. These typical igniters provide ignition energy intermittently, and the spark event must coincide with a flammable mixture local to the igniter in order for engine ignition to occur. Often this means fuel will be sprayed toward the combustor wall near the igniter to improve the chances of ignition. This increased concentration of fuel can wet the igniter, making it more difficult to light and can lead to carbon formations which will also make ignition more difficult.

Although the igniter is used for a very minute portion of the life of the engine, a great deal of care must be devoted to it such that it does not oxidize or melt in the course of the mission when it is not functioning. Typical igniters can fail instantaneously and without warning, which also requires special design considerations in anticipation of failure. The high voltages that are used to generate the spark can often find alternate paths in the circuit leading to the spark surface across which they can discharge and in such cases, the igniters can fail to provide an adequate spark for engine ignition. The high voltage transformers required to generate the arc are heavy and require heavy electrical cables and connectors. The sparks have trouble generating enough heat to vaporize cold fuel in cold conditions. Fuel must be in vapor form before it will ignite and burn. High velocity air, as may occur in altitude flameout situations can quench the spark out before it ignites significant fuel. The ignition process can interfere with electronic device functions through stray electromagnetic interference (EMI). Sparking systems have difficulty in maintaining a lit combustor under very low power or other unstable or transient mode of operation. Often, pilots might choose to leave the igniters on for an extended period of the mission to prevent flameout, such as during bad weather. Leaving the spark plugs on for the entire mission can lead to early igniter deterioration and failure.

Such conventional methods and systems have generally been considered satisfactory for their intended purpose. However, there is still a need in the art for systems and methods that allow for improved ignition. There also remains a need in the art for such systems and methods that are easy to make and use. This disclosure provides a solution for these needs.

SUMMARY OF THE INVENTION

A new and useful ignition system includes a housing defining an interior and an exhaust outlet. The housing is configured and adapted to be mounted to a combustor case to issue flame from the exhaust outlet into the combustor for ignition and flame stabilization within the combustor. A fuel injector is mounted to the housing with an outlet of the fuel injector directed to issue a spray of fuel into the interior of the housing. An igniter is mounted to the housing with an ignition point of the igniter proximate the outlet of the fuel injector for ignition within the interior of the housing.

In certain embodiments, an inner wall is mounted in the interior of the housing, spaced apart inward from the housing to define an air plenum between the inner wall and the housing and to define a combustion chamber within the inner wall. An air swirler can provide fluid communication from the air plenum into the combustion chamber, wherein the air swirler is configured to impart swirl onto a flow of air entering the combustion chamber. For example, a spaced apart pair of air swirlers can be provided, one of the swirlers being proximate a first end of the inner wall, and another of the swirlers being proximate a second end of the inner wall. Each air swirler can be configured to impart swirl onto a flow of air entering the combustion chamber.

An elbow can be included with an elbow inlet operatively connected to receive combustion products from the combustion chamber along a longitudinal axis and with an elbow outlet in fluid communication with the inlet. The elbow outlet can be aligned along an angle relative to the longitudinal axis. An exhaust tube can be included in fluid communication with the elbow outlet for issuing combustion gases from the exhaust tube. The housing and the inner wall can be slidingly engaged to one another. The inner wall and the elbow can be slidingly engaged to one another. The exhaust tube and the elbow can be slidingly engaged to one another. The exhaust tube and the housing can be slidingly engaged to one another. These sliding engagements can accommodate relative thermal expansion and contraction. An axial spring can bias the elbow toward the inner wall, and a radially oriented spring can bias the exhaust tube toward the elbow.

The axial length of the combustion chamber can be about twice the interior diameter of the combustion chamber in length. The inlet diameter of the elbow inlet can be between about 25% and 75% of the interior diameter of the combustion chamber. For example, the inlet diameter of the elbow inlet can be about 50% of the interior diameter of the combustion chamber. The elbow inlet diameter can be about equal to the elbow outlet diameter in length. It is also contemplated that the outlet diameter of the exhaust tube can be about 0.5 to 0.6 times the inlet diameter of the elbow inlet.

In another aspect, the housing can define an air inlet configured and adapted to issue air for combustion into the interior of the housing. The air inlet and the exhaust outlet can be aligned to accommodate attachment of the housing to a combustor to issue flame from the exhaust outlet into the combustor and to take in compressor discharge air through the air inlet from a high pressure casing outboard of the combustor. It is also contemplated that the air inlet can be radially oriented relative to a longitudinal axis defined by the housing, and the exhaust outlet can be aligned with the longitudinal axis.

A new and useful method of ignition for a combustor in a gas turbine engine includes initiating a fuel and air flow through the fuel injector of an ignition system as described above. The method also includes igniting the fuel and air flow with the igniter and igniting a fuel and air flow in a combustor with a flame from the exhaust outlet of the ignition system.

Also disclosed is a new and useful method of combustion stabilization for a combustor in a gas turbine engine. The method includes detecting a combustion instability in a combustor and issuing a flame from the exhaust outlet of an ignition system as described above into the combustor to stabilize combustion in the combustor. The method can further include increasing flame strength from the exhaust outlet of the ignition system in response to weak flame conditions in the combustor, and decreasing flame strength from the exhaust outlet of the ignition system in response to stable flame conditions in the combustor.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 2 is a cross-sectional side elevation view of the ignition system of FIG. 1, showing the combustion chamber of the ignition system;

FIG. 3 is a perspective view of an exemplary embodiment of a swirler for use in an ignition system as shown in FIG. 2, showing slotted swirl passages;

FIG. 4 is a cross-sectional side elevation view of the ignition system of FIG. 2, schematically showing the flow of air and fuel spray within the combustion chamber;

FIG. 5 is a cross-sectional perspective view of an exemplary embodiment of an elbow for use in an ignition system as shown in FIG. 2, showing inlet and outlet openings with the same diameter;

DETAILED DESCRIPTION OF THE PREFERRED EMBODIMENTS

Figure 1:
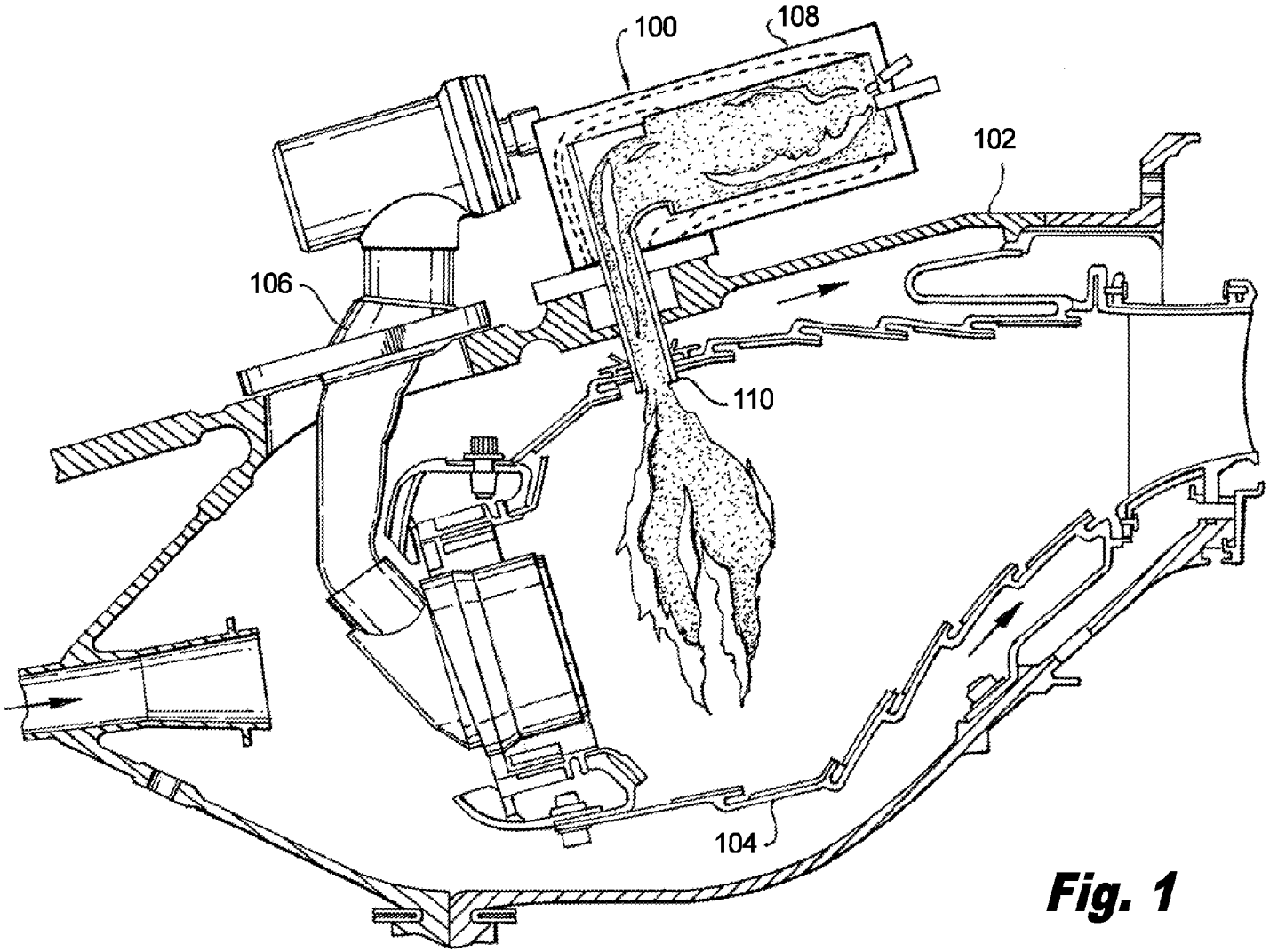
FIG. 1 is a schematic view of an exemplary embodiment of an ignition system, showing the housing of the ignition system mounted to the high pressure casing and combustor of a gas turbine engine.

Reference will now be made to the drawings wherein like reference numerals identify similar structural features or aspects of the subject invention. For purposes of explanation and illustration, and not limitation, a partial view of an exemplary embodiment of an ignition system is shown in FIG. 1 and is designated generally by reference character 100. Other embodiments of ignition systems, or aspects thereof, are provided in FIGS. 2-7, as will be described. The systems and methods of the invention can be used, for example, to employ liquid fuel injection to improve the ignition performance of advanced engines. The systems and methods can be used in new engines, as well as to retrofit to existing engines to replace traditional ignition systems, for example.

In FIG. 1, ignition system 100 is shown mounted to a high pressure casing 102 outboard of a combustor 104 of a gas turbine engine. Compressor discharge air enters the high pressure casing and fills the interior of high pressure casing 102. Some of the compressor discharge air passes into combustor 104 through the fuel injectors 106. Some of the compressor discharge air passes through the wall of combustor 104 as cooling air. Another smaller portion of the compressor discharge air can be routed into ignition system 100.

Ignition system 100 includes a housing 108 in the form of a pressure case defining an interior. Ignition system 100 also includes an exhaust outlet 110. Housing 108 is mounted to a combustor 104 to issue flame from exhaust outlet 110 into combustor 104 for ignition and flame stabilization within combustor 104.

Referring now to FIG. 2, a fuel injector 112 is mounted to housing 108 with an outlet of fuel injector 112 directed to issue a spray of fuel into the interior of housing 108. Fuel injector 112 is connected to a fuel line, as indicated schematically in FIG. 2. An igniter 114 in the form of a glow plug is mounted to housing 108 with an ignition point of igniter 114 proximate the outlet of fuel injector 112 for ignition within the interior of housing 108. As indicated schematically in FIG. 2, igniter 114 is connected to a DC power source. While a DC glow plug is preferred in certain applications, a conventional spark igniter located near the nozzle to provide intermittent ignition energy can be used in appropriate applications.

A cylindrical inner wall 116 is mounted in the interior of housing 108, spaced apart inward from housing 108 to define an air plenum 118 between inner wall 116 and housing 108. The inside of inner wall 116 defines a combustion chamber. A spaced apart pair of air swirlers 120 and 122 are provided. Swirler 120 proximate a first end of inner wall 120 proximate fuel injector 112 and igniter 114. Swirler 122 is proximate the opposite end of inner wall 116. Air swirlers 120 and 122 provide fluid communication from air plenum 118 into the combustion chamber inside inner wall 116. Each of the air swirlers 120 and 122 is a radial swirler configured to meter and impart swirl onto a flow of air entering the combustion chamber. Cool swirling air clings to the inner surface of inner wall 116, and spreads both ways along longitudinal axis A. The two swirling flows engage in the interior of inner wall 116. This provides a stable, flame holding flow while providing cooling flow to the surface of inner wall 116, since the flame can be maintained without attaching to inner wall 116.

Inner wall 116 can be of ceramic or ceramic composite material, and swirlers 120 and 122 can be made of similar materials or metallic since they are cooled by the air flow into the combustion chamber. Those skilled in the art will readily appreciate that any other suitable high temperature materials can be used, and that these components can be formed separately or integrally as appropriate for given applications. Provision of two swirlers encourages some of the air to flow on the outer or backside of the combustion chamber, helping to cool wall 116 from the backside.

Swirlers 120 and 122 each have three or more integral tabs 121 as shown in FIG. 2 which centralize and support the cylindrical combustion chamber in outer housing 108. The air flow split through either of swirlers 120 and 122 can vary between about 25% to 75% of the total flow, and in certain applications a 50%-50% split is preferred. The swirl holes through swirlers 120 and 122, as shown in FIG. 2, are equally distributed around the respective swirler circumference and have trajectories off set from the swirler center line to provide swirl to the flow therethrough. In certain applications it is preferable for swirlers 120 and 122 to be in a co-swirling configuration, however, those skilled in the art will readily appreciate that in suitable applications, counter-swirling configurations can also be used. While shown with cylindrical swirl holes in FIG. 2, slots can also be used as shown in swirler 220 shown in FIG. 3. A ceramic thermal barrier plate 123 is included between swirler 121 and housing 108. FIG. 4 schematically indicates the flow of air through system 100 with arrows, and schematically indicates the spray of fuel with stippling.

An elbow 124 is included with an elbow inlet operatively connected to receive combustion products from the combustion chamber along a longitudinal axis A. The inlet diameter d can be between about 25% and 75% of the combustion chamber diameter D. In certain applications, the inlet diameter d is preferably about 50% of the diameter D. Elbow 124 has an elbow outlet in fluid communication with the elbow inlet. The elbow outlet is aligned along a radial angle relative to longitudinal axis A. In system 100, the length of the combustion chamber is about twice the diameter D.

An exhaust tube 126 is connected in fluid communication with the outlet of elbow 124 for issuing combustion gases from exhaust outlet 110 of exhaust tube 124. The diameter dl of the outlet passage through exhaust tube 126 can be in a range of about 0.5 to 0.6 times the diameter d of the elbow inlet. All of the wall surfaces in contact with combustion products can be made from high temperature materials which can be metallic, but can preferably be ceramic or ceramic composite materials in certain applications. While elbow 124 has an inlet diameter and an outlet diameter smaller than d, FIG. 5 shows another exemplary embodiment of an elbow 224 in which the inlet and outlet both have the same diameter d.

Figure 6:
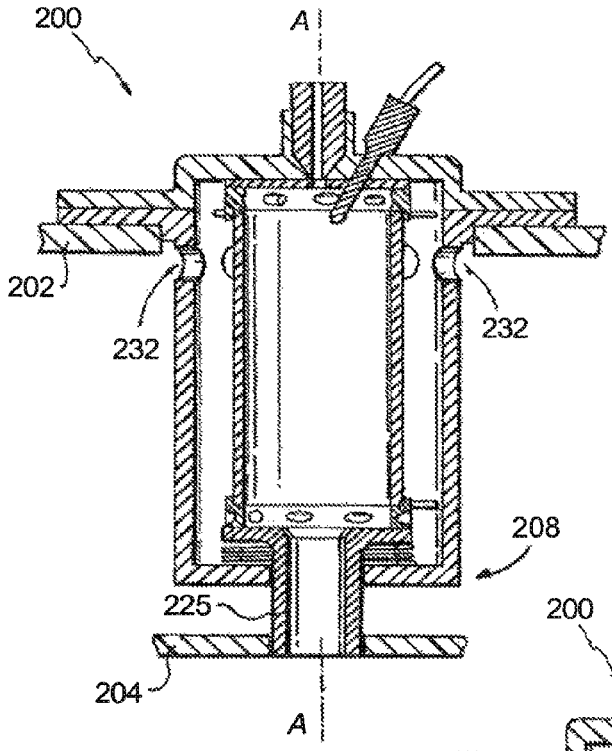
FIG. 6 is a cross-sectional side elevation view of another exemplary embodiment of an ignition system, showing an outlet axis aligned with the longitudinal axis of the combustion chamber.
Figure 7:
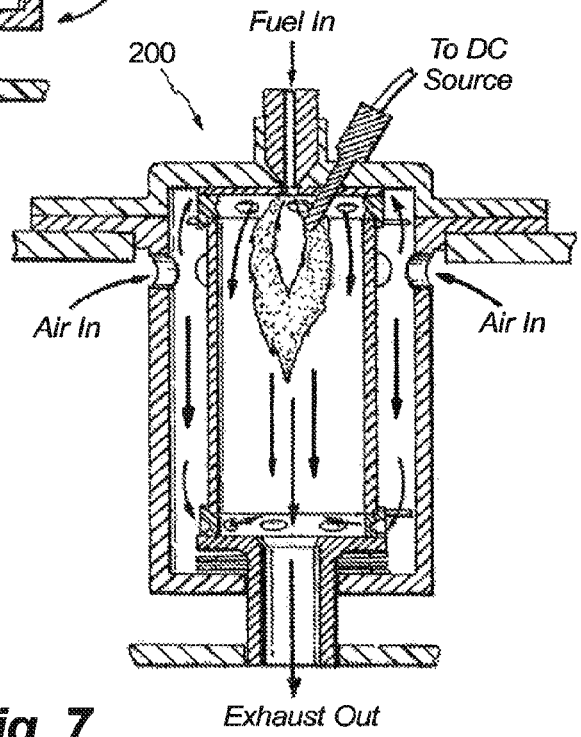
FIG. 7 is a cross-sectional side elevation view of the ignition system of FIG. 6, schematically showing the flow of air and fuel spray within the combustion chamber.

In FIG. 2, the elbow outlet is aligned along a radial angle relative to longitudinal axis A. However, any other suitable outlet alignment can be used. For example, FIG. 6 shows an ignition system 200 similar to ignition system 100, but with the axis of exhaust outlet 225 is aligned with the longitudinal axis A. Housing 208 is mounted to high pressure casing 202 so that air will flow into housing 208 through radially oriented inlet 232, and outlet 225 is mounted to issue flame into combustor 204. FIG. 7 shows the air flow through system 200 schematically with arrows, and shows the spray of fuel into the combustion chamber of system 200 schematically with stippling.

In order to accommodate thermal expansion and contraction gradients, many of the components of ignition system 100 are slidingly engaged to one another. Swirlers 120 and 122 are not seated, but centralized by outer tabs. Swirlers 120 and 122 seat the cylindrical flow elements in a sliding fashion to prevent or minimize any bending moments being transmitted to the cylinder. Exhaust tube 126 and elbow 124 are slidingly engaged to one another for relative movement in the direction of longitudinal axis A. Exhaust tube 126 and housing 108 are slidingly engaged to one another for relative movement in the radial direction relative to longitudinal axis A.

An axial spring 128 biases elbow 124 toward inner wall 116 to keep elbow 124, inner wall 116, and swirlers 120 and 122 assembled to housing 108. A radially oriented spring 130 biases exhaust tube 126 toward elbow 124 to keep the inlet flange of exhaust tube 126 engaged to the outlet of elbow 124. However, those skilled in the art will readily appreciate that any other suitable materials can be used without departing from the scope of this disclosure.

Housing 108 includes an air inlet 132 for issuing air for combustion into the interior of the housing 108. Air inlet 132 and exhaust outlet 110 are aligned to accommodate attachment of housing 108 to the walls of combustor 104 and high pressure casing 102 to issue flame from exhaust outlet 110 into combustor 104 and to take in compressor discharge air through air inlet 132 from high pressure casing 102 outboard of combustor 104. Ignition system 100 can be retrofitted onto a gas turbine engine to replace a traditional igniter by removing the traditional igniter and connecting air inlet 132 with a modified air passage of the high pressure casing, and by connecting exhaust tube 126 to issue into the combustor.

Ignition systems as described above are based around a small combustion volume relative to the main combustor, and remote from the main combustion chamber. The housing, e.g., housing 108, is secured to the exterior of the engine to allow routine maintenance similar to conventional igniters. The orientation of the internal conduits containing high temperature combustion gases are such as to permit the axis of the main combustion element, e.g., the axial length of housing 108, to lay parallel to the engine axis, reducing the overall diameter of the engine envelope. The elbow, e.g., elbow 124, and exhaust tube whose axis is normal to the engine axis, allow the engagement with the engine combustor to be similar to conventional ignition devices. Those skilled in the art will recognize that any suitable modification of this orientation can also be used, for example to allow for improved ignition performance as needed for specific applications.

A relatively, small amount of metered air enters the combustion volume, e.g., inside housing 108, fed from the pressure of the main engine air supply. With the use of air swirlers, e.g. air swirler 120, to admit the air into the combustion chamber of the ignition system, an air flow pattern is developed which enhances stable combustion while a small amount of fuel is injected in the air through an appropriate fuel injector, e.g., injector 112. The atomized fuel is ignited by the heat of an electric element or glow plug igniter, e.g., igniter 114, which is fed by low voltage DC electric current. The fuel ignites to produce a continuous stream of heat in the small combustor. The heat is of sufficient intensity to be able to ignite the fuel nozzle in the main combustor.

Once engine ignition has occurred, the electric element can be shut off. The flame in the small combustor can be left on continuously for the duration of the mission, supplying heat and radicals present in the combustion products to the main combustor at all times. Because the supply of fuel is small, the temperature produced by the ignition system does not overwhelm the temperature from the main fuel injectors when stable combustion is achieved. Only under very low power condition or during ignition processes does the energy from the ignition system rival the energy derived from the main combustor nozzles. As such, the impact from the ignition system is diminished at higher engine power and dominates at low engine power. This decoupled phasing and continuous duty helps the ignition system extend the flammability limits over that of a conventional combustor.

The hot gases from the ignition system can be projected deeply into the main combustor volume. This allows the spray pattern from the main nozzles to be optimized for durability and emissions compared to conventional situations where fuel must be sprayed towards the wall in order to approach a traditional igniter.

The continuous injection of heat into the main combustor allows for faster, higher quality main combustor ignition at lower, more adverse ignition conditions. Conventional fuel injectors require substantial fuel flow at low power to be able to form an atomized spray of sufficient quality to ignite. Aerated injectors require substantial air pressure to atomize fuel. At low starting speeds, air flows are low and the relatively high fuel flows are required for atomization produce relatively hot ignition situations when they finally ignite. This is exemplified by torching seen at the exhaust and large quantities of white smoke seen in cold weather starts. Within the ignition system, e.g., ignition system 100, the ignition of the nozzle, e.g., of injector 112, can be optimized for low flow conditions. The resulting flame is capable of igniting low quality sprays in the main combustor, speeding up engine ignition and reducing the overall temperature experienced during the main ignition sequence. This can prolong the life of the engine hot end components.

The ignition system can remain on continuously during a mission, protecting the main combustor from flame out. Its power can be controlled to vary with engine conditions through the fuel flow delivered to the ignition system. As such, it is capable of withstanding large excursions in engine conditions thereby assisting the main combustor.

The ignition system can utilize relatively low, DC power electric elements for ignition. These igniter devices are not prone to contamination from carbon deposits and are not prone to wetting or icing. They do not require high voltage cables and connectors, allowing for a lighter, more dependable delivery of ignition energy compared to higher voltage traditional igniters. They also emit significantly less electromagnetic interference to neighboring electronic equipment.

The size of the combustion chamber should be compact enough to easily be accommodated in an engine envelope and to utilize a small amount of fuel but be large enough to support a strong, stable flame. It has been found that using a cylindrical geometry with an approximate diameter of 1.5 inches (3.81 cm) can meet these objectives for certain typical applications.

Low emissions, lean burn type systems, present greater difficulty to ignition and flameout situations. The decoupled nature of the ignition systems described herein allow them to optimize the conditions for ignition within a confined volume away from the main nozzles allowing them to burn more cleanly while maintaining adequate ignition and re-light capability.

An exemplary method of ignition for a combustor in a gas turbine engine includes initiating a fuel and air flow through the fuel injector of an ignition system as described above. The method also includes igniting the fuel and air flow with the igniter, e.g., igniter 112, and igniting a fuel and air flow in a combustor with the flame from the exhaust outlet of the ignition system. An exemplary method of combustion stabilization for a combustor in a gas turbine engine includes detecting a combustion instability in a combustor and issuing a flame from the exhaust outlet of an ignition system as described above into the combustor to stabilize combustion in the combustor. The method can further include increasing flame strength from the exhaust outlet of the ignition system in response to weak flame conditions in the combustor, and decreasing flame strength from the exhaust outlet of the ignition system in response to stable flame conditions in the combustor. While shown and described in the exemplary context of gas turbine engines, those skilled in the art will readily appreciate that ignition systems in accordance with this disclosure can be used in any other suitable application without departing from the scope of this disclosure.

The methods and systems of the present invention, as described above and shown in the drawings, provide for ignition with superior properties including easier startup, continuous operation, and enhanced reliability. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An ignition system, comprising:

a housing defining an interior and an exhaust outlet, wherein the housing is configured and adapted to be mounted to a combustor to issue flame from the exhaust outlet into the combustor for ignition and flame stabilization within the combustor;

a fuel injector mounted to the housing with an outlet of the fuel injector directed to issue a spray of fuel into the interior of the housing;

an igniter mounted to the housing with an ignition point of the igniter proximate the outlet of the fuel injector for ignition within the interior of the housing;

an inner wall mounted in the interior of the housing and defining a longitudinal axis, wherein the inner wall is spaced apart inward from the housing to define an air plenum between the inner wall and the housing and to define a combustion chamber within the inner wall;

first and second air swirlers axially spaced apart along the longitudinal axis, the first air swirler being proximate a first end of the inner wall, the second air swirler being proximate a second end of the inner wall, wherein both the first and second air swirlers are configured to impart swirl onto a flow of air entering the combustion chamber; and an exhaust tube coupled to the second air swirler such that the second air swirler is disposed axially along the longitudinal axis between the first air swirler and the exhaust tube and such that the exhaust tube conveys combustion products to the exhaust outlet.

2. An ignition system as recited in claim 1, wherein at least one of the first and second air swirlers provide fluid communication from the air plenum into the combustion chamber.

3. An ignition system as recited in claim 1, wherein the combustion chamber defines an interior diameter and an axial length, wherein the axial length is about twice the interior diameter in length.

4. An ignition system as recited in claim 1, further comprising an elbow with an elbow inlet operatively connected to receive combustion products from the combustion chamber along the longitudinal axis and an elbow outlet in fluid communication with the inlet, wherein the elbow outlet is aligned along an angle relative to the longitudinal axis.

5. An ignition system as recited in claim 4, wherein the elbow inlet defines an inlet diameter, wherein the combustion chamber defines an interior diameter, and wherein the inlet diameter of the elbow inlet is between about 25% and 75% of the interior diameter of the combustion chamber.

6. An ignition system as recited in claim 4, wherein the elbow inlet defines an inlet diameter, wherein the elbow outlet defines an outlet diameter, and wherein the inlet diameter is about equal to the outlet diameter in length.

7. An ignition system as recited in claim 4, wherein the exhaust tube is in fluid communication with the elbow outlet for issuing combustion products from the exhaust tube.

8. An ignition system as recited in claim 7, wherein the exhaust tube defines an outlet diameter, wherein the elbow inlet defines an inlet diameter, and wherein the outlet diameter of the exhaust tube is about 0.5 to 0.6 times the inlet diameter of the elbow inlet.

9. An ignition system as recited in claim 7, wherein the housing and the inner wall are slidingly engaged to one another, the inner wall and the elbow are slidingly engaged to one another, the exhaust tube and the elbow are slidingly engaged to one another, and the exhaust tube and the housing are slidingly engaged to one another to accommodate relative thermal expansion and contraction.

10. An ignition system as recited in claim 9, further comprising an axial spring biasing the elbow toward the inner wall.

11. An ignition system are recited in claim 9, further comprising a radially oriented spring biasing the exhaust tube toward the elbow.

12. An ignition system as recited in claim 1, wherein the housing defines an air inlet configured and adapted to issue air for combustion into the interior of the housing.

13. An ignition system as recited in claim 12, wherein the air inlet and the exhaust outlet are aligned to accommodate attachment of the housing to the combustor to issue flame from the exhaust outlet into the combustor and to take in compressor discharge air through the air inlet from a high pressure casing outboard of the combustor.

14. An ignition system as recited in claim 12, wherein the air inlet is radially oriented relative to the longitudinal axis, and wherein the exhaust outlet is aligned with the longitudinal axis.

15. An ignition system as recited in claim 1, wherein the exhaust tube is coaxial with the longitudinal axis defined by the inner wall.

16. An ignition system as recited in claim 1, wherein the exhaust tube is angled with respect to the longitudinal axis defined by the inner wall.

17. An ignition system as recited in claim 1, wherein the exhaust tube is substantially orthogonal with respect to the longitudinal axis defined by the inner wall.

18. An ignition system as recited in claim 1, wherein the exhaust tube is angled with respect to the longitudinal axis defined by the inner wall.

19. An ignition system as recited in claim 1, wherein the exhaust tube is substantially orthogonal with respect to the longitudinal axis defined by the inner wall.

20. An ignition system, comprising:

a housing defining an interior and an exhaust outlet, wherein the housing is configured and adapted to be mounted to a combustor to issue flame from the exhaust outlet into the combustor for ignition and flame stabilization within the combustor;

a fuel injector mounted to the housing with an outlet of the fuel injector directed to issue a spray of fuel into the interior of the housing;

an igniter mounted to the housing with an ignition point of the igniter proximate the outlet of the fuel injector for ignition within the interior of the housing;

an inner wall mounted in the interior of the housing and defining a combustion chamber within the inner wall and further defining an upstream end and a downstream end relative to a flow of combustion products through the combustion chamber, wherein the inner wall is spaced apart inward from the housing to define an air plenum between the inner wall and the housing;

upstream end and downstream end air swirlers, the upstream end air swirler being proximate the upstream end of the inner wall, the downstream end air swirler being proximate the downstream end of the inner wall, wherein both the upstream end and downstream end air swirlers are configured to impart swirl onto a flow of air entering the combustion chamber; and an exhaust tube coupled to the downstream end air swirler such that the downstream end air swirler is disposed upstream of the exhaust tube and downstream of the upstream end air swirler and such that the exhaust tube conveys combustion products to the exhaust outlet.

* * * * *